US005896688A

United States Patent [19]

Aiken et al.

[11] Patent Number: 5,896,688

[45] Date of Patent: Apr. 27, 1999

[54] SCROLLING SIGN WITH MANUALLY OPERATED CHANGE MECHANISM

[75] Inventors: Robert B. Aiken, Mequon; Robert C. Clapper, Grafton, both of Wis.

[73] Assignee: Milwaukee Sign Co., Inc., Grafton, Wis.

[21] Appl. No.: 08/853,216

[22] Filed: May 9, 1997

[51] Int. Cl.[6] ..... G09F 11/18

[52] U.S. Cl. ..... 40/519; 40/522

[58] Field of Search ..... 40/518, 519, 522, 40/523

[56] References Cited

U.S. PATENT DOCUMENTS

| | | | |
|---|---|---|---|
| 1,009,543 | 11/1911 | Mehlhorn | 40/518 |
| 1,872,145 | 8/1932 | Hurford | 40/518 |
| 4,741,118 | 5/1988 | Aiken et al. | 40/518 |
| 4,995,183 | 2/1991 | Aiken, Sr. | 40/518 |
| 5,412,893 | 5/1995 | Aiken, Sr. | 40/518 |

*Primary Examiner*—Brian K. Green
*Assistant Examiner*—Daniel Gambrill
*Attorney, Agent, or Firm*—Andrus, Sceales, Starke & Sawall

[57] ABSTRACT

A scrolling sign that includes a plurality of webs each having indicia which are displayed through a window on the sign face. The plurality of webs are disposed in vertical and horizontal alignment with one another. Each of the webs are disposed between a forward and a reverse web roll. A plurality of forward and reverse web rolls are rotatably mounted to a modular unit such that the individual web rolls are aligned. A drive shaft passes through each of the web rolls and is engageable with only one of the web rolls at a time. The engagement of the drive shaft with the web rolls, as well as rotation of the individual web rolls is manual. The drive shaft includes a driving mechanism which prevents the drive shaft from being rotated in an improper direction.

29 Claims, 5 Drawing Sheets

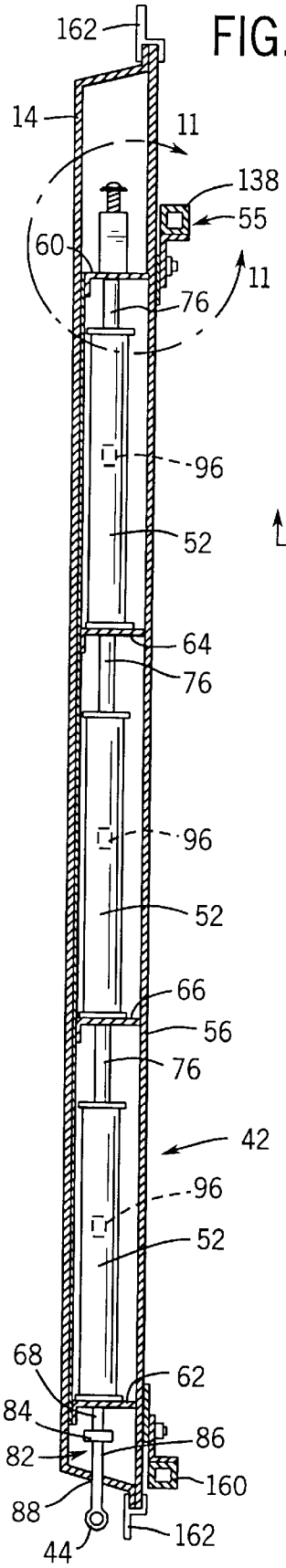
FIG. 3
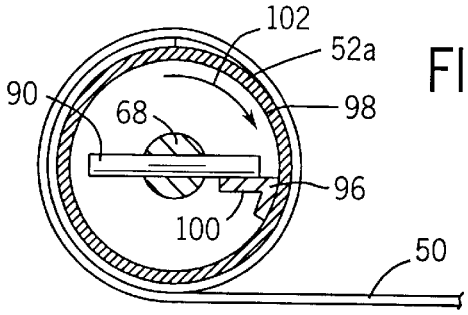
FIG. 7
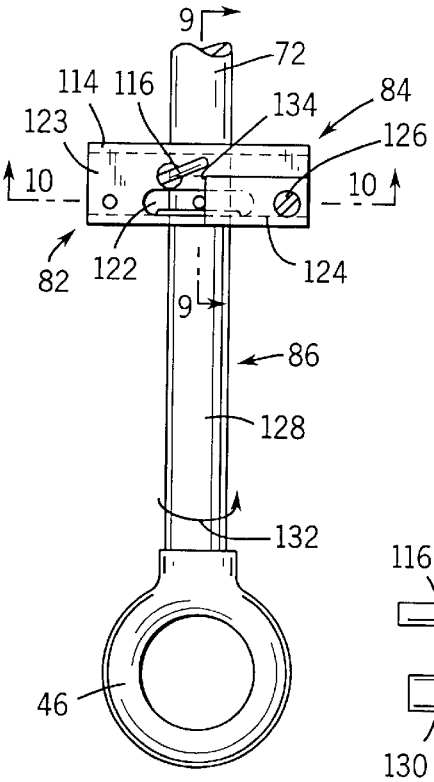
FIG. 8
FIG. 9
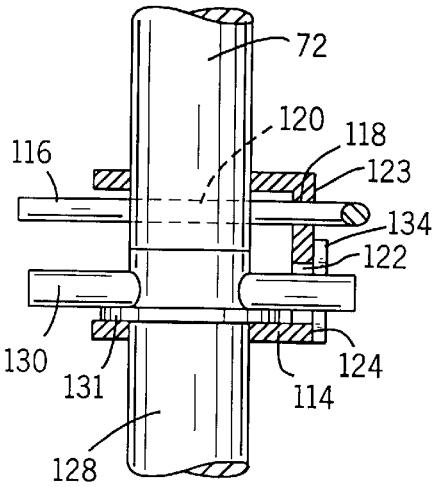
FIG. 10
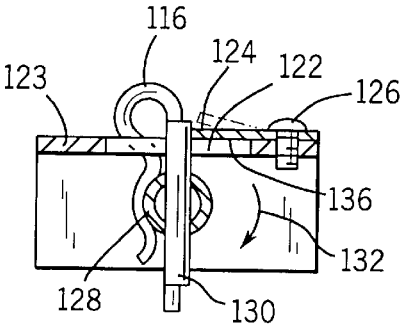

FIG. 11
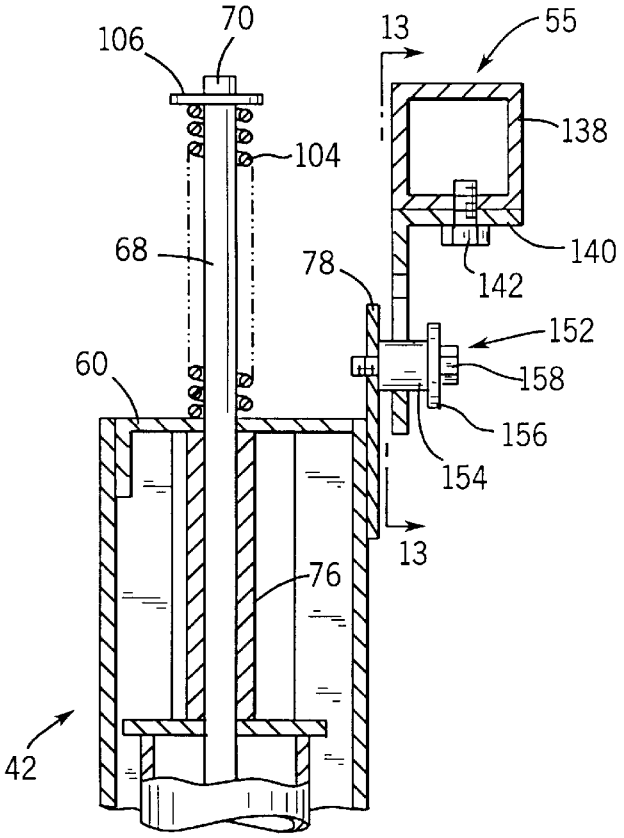
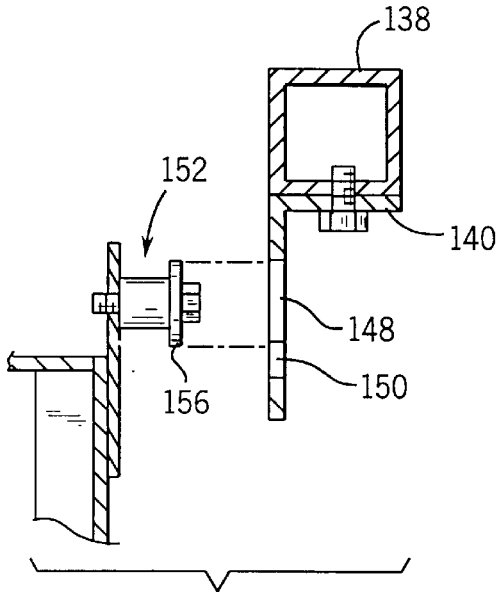
FIG. 12
FIG. 13
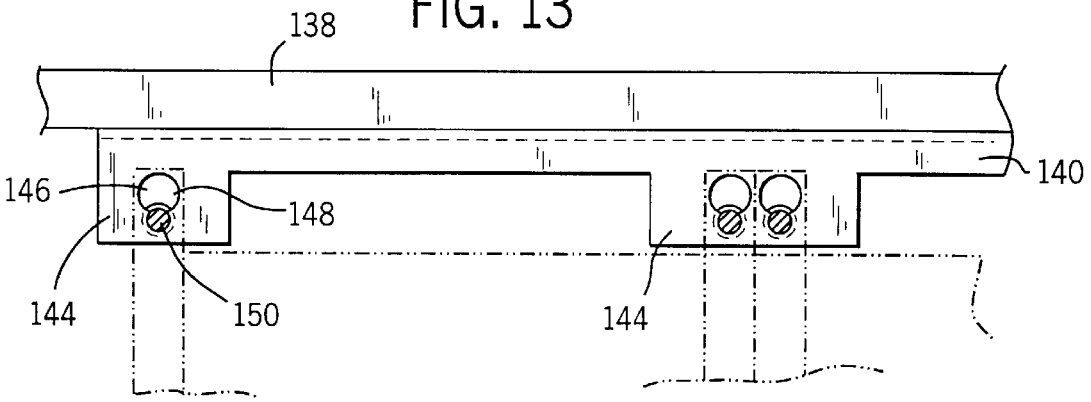

SCROLLING SIGN WITH MANUALLY OPERATED CHANGE MECHANISM

BACKGROUND OF THE INVENTION

The present invention relates to a sign of the type in which indicia are changed by scrolling a web containing the indicia across one or more viewing windows in the sign. More specifically, the invention is directed to a modular digit mechanism including a driving mechanism that permits the manual scrolling of the indicia based on the manually adjustable position of the driving mechanism.

Scrolling signs are well known in the art. They are particularly useful for gasoline service stations and the like where information about a wide range of products is displayed on the signs. It is often necessary or desirable to change the information displayed due to competitive factors, seasonal considerations, special promotions, or numerous other reasons. Motor fuels, such as gasoline, are typical of the product for which information, such as pricing, changes frequently. The price of gasoline is typically advertised to the consumer by signage located on the premises of the service station. The signs are usually close to the road and thus remote from the office or payment booth. These signs are usually elevated to increase their visibility to passing motorists. Such signs are often backlighted for the same reasons, as well as to emphasize brand names and other consumer information. All of these factors raise problems with respect to changing pricing information.

The changing of pricing or other information by exchanging placards on the sign is at best cumbersome, and because of environmental damage and vandalism, somewhat undesirable. Additionally, the unattached placards can fall during changing, potentially resulting in injury to the user. These problems led to the development and use of electrically changeable signs wherein the letters are formed from a matrix having incandescent light bulbs, liquid crystal or light emitting diode elements or magnetic flippers. However, the use of such matrices often lessens or destroys the graphic features or aesthetics of the sign. Colors, fonts or other design features of the above-mentioned changeable indicia are usually severely limited.

Over the years, a number of scrolling web signs have been developed which permit the use of enhanced graphics, meet the needs of providing protected indicia and are readily changeable. These provide a very desirable, aesthetically pleasing signage for billboards and other uses in which the indicia of the sign have to change from time to time.

Scrolling web signs include indicia which may be changed, yet still be protected from the environment with a protective transparent cover sheet, and are an improvement over signs of the type wherein the letters are generally removable from the ground by use of elongated poles and the like for hanging the letters on positions provided in the sign. The scrolling signs are also more aesthetically pleasing than the matrix type signs, and permit a wider range of graphics to be used. The covered indicia of the scrolling web signs are less susceptible to soiling, wind damage and vandalism. All of these factors make the scrolling web sign preferable over many of the signs of the prior art in providing signage where the indicia must be changeable.

Examples of such signs are seen in U.S. Pat. No. 4,741,118 entitled "Sign With Improved Scrolling Mechanism", issued to R. Aiken et al. on May 3, 1988; U.S. Pat. No. 4,995,183 entitled "Scrolling Sign With Improved Web Guide", issued to R. Aiken on Feb. 26, 1991; and U.S. Pat. No. 5,412,893 entitled "Manually Operable Scrolling Web Sign", issued to R. Aiken on May 9, 1995.

U.S. Pat. No. 4,741,118 discloses a scrolling sign having a sign face with windows in which indicia may appear. A pair of shafts are mounted in the framework of the sign for containing a plurality of web rolls between which webs containing indicia extend. A drive mechanism, including an electric motor, simultaneously rotates the shafts. Clutches interposed between the web rolls and the shafts are selectively operable to move the webs in one or the other direction across the window to alter the displayed indicia. A constantly applied differential brake is also coupled to the web rolls to maintain tension on the webs and to assist in their movement. The control for the motor and clutches may be placed at a position remote from the sign and cabled to the sign.

U.S. Pat. No. 5,412,893 discloses a scrolling sign which includes a plurality of web rolls each having indicia which is displayed through a window on the sign face. A switch control on the sign allows the user to select which of the indicia is to be changed. An electric clutch assembly contained within the sign selectively connects a manual crank mechanism with the desired scrolling web. With the proper scrolling web selected, the user is able to manually adjust the web to change the indicia displayed on the sign.

While the electric scrolling web signs of the prior art type have been widely accepted, a need has developed for a completely manual scrolling price sign that has the same aesthetic qualities and versatility as the electric powered scrolling web signs currently available but which is lower cost in both construction and installation.

SUMMARY OF THE INVENTION

The subject invention is directed to a mechanical scrolling web sign wherein indicia, such as pricing information, on the sign can be changed by use of a hand crank. The price changes can be completed in a minimum amount of time and with a minimum effort. The manual scrolling web sign allows price changes on demand by coupling a hand crank to the sign, manually positioning a drive shaft, and subsequently scrolling the web to display indicia corresponding to the desired price.

The mechanical scrolling web sign may incorporate a plurality of indicia webs. The indicia webs are mounted to a modular digit mechanism that arranges the webs in alignment with one another. The individual indicia are printed on a web that is wound between a forward web roll and a reverse web roll. Each of the modular digit mechanisms of the subject invention includes a forward and a reverse drive shaft which are manually movable with respect to the web rolls. Movement of the drive shafts allows the user to select the web to be scrolled, such that no electric power is required to operate any clutch mechanism to select the proper web to be scrolled.

The manual scrolling web sign of the present invention is particularly well suited in installations where remote electrical cable controlled systems are impractical. It is particularly efficient for upgrading existing signage at service stations and the like.

The manual scrolling web sign of the subject invention is designed to be easy to use and requires only that the operator manually move the drive shaft relative to the web rolls to select one of the webs to be changed. When the proper web is selected, the operator may turn the hand crank actuator until the proper indicia is displayed. The present invention eliminates the need for arm changers, ladders or lifts previously required for manually changing the indicia and further minimizes the risk of wind or other environmental conditions damaging the indicia or the risk of vandalism, such as removing or altering the indicia.

By attaching the modular digit mechanisms of the subject invention to the face and/or face frame of the scrolling web sign, lighted indicia can be produced through clear areas of an opaque sign face. With the modular digit mechanisms attached to the face frame, the entire face frame and the modular digit mechanisms attached thereto can be pivoted away to provide easy access to the lighting contained within the sign cabinet. Additionally, the illumination properties of the sign can be modified such that the manual scrolling sign of the invention can be provided with full face illumination.

The manual scrolling sign of the present invention incorporates a driving mechanism connected to each of the forward and reverse drive shafts. The driving mechanism is constructed such that the forward and reverse drive shafts are each rotatable in only one direction. The driving mechanisms are positioned such that the direction of permissible forward drive shaft rotation is opposite the direction of permissible reverse drive shaft rotation.

In the preferred embodiment, the entire scrolling mechanism is modular and the scrolling mechanism is attached to the face such that the face frame and the attached scrolling mechanisms can swing out to provide easy access to the lamps and for servicing of the sign. Additionally, the combined face frame and attached scrolling mechanisms can be used as a single unit to retrofit existing signs. All of the indicia are within an enclosed surface and are protected from soiling and environmental damage.

It is an object and feature of the present invention to provide a scrolling web sign wherein the indicia on the web may be enclosed with respect to the environment by a cover panel which defines a window through which the indicia is displayed.

It is a further object of the present invention to provide a manual scrolling web sign wherein a plurality of scrolling webs may be placed in alignment with one another on a single mounting frame and selectively operated by a hand crank.

It is yet another object and feature of the present invention to provide a scrolling web sign with easy access to illumination devices and sign mechanics.

It is yet another object and feature of the present invention to provide a scrolling web sign wherein the scrolling and selecting mechanism is entirely manual such that no power connection is needed to change the indicia.

It is a further object of the present invention to provide a modular digit mechanism including a plurality of indicia, the modular digit mechanism being easily removable or used to retrofit existing signage.

The foregoing and other objects will be more fully understood from the following drawings and detailed description of the invention.

BRIEF DESCRIPTION OF THE DRAWINGS

FIG. 3 is a section view taken generally along line 3—3 of FIG. 1.

FIG. 7 is a section view taken generally along line 7—7 of FIG. 4.

FIG. 8 is an elevation view of the crank ring and ratchet drive assembly of the subject invention.

FIG. 9 is a section view taken generally along line 9—9 of FIG. 8.

FIG. 10 is a section view taken generally along line 10—10 of FIG. 8.

FIG. 11 is an enlarged fragmentary view taken generally along line 11—11 of FIG. 3.

FIG. 12 is an enlarged fragmentary view looking generally in the same direction as FIG. 11.

FIG. 13 is a front elevation view of the attachment means for the sign taken along line 13—13 in FIG. 11.

DETAILED DESCRIPTION OF THE PREFERRED EMBODIMENT

Figure 1:
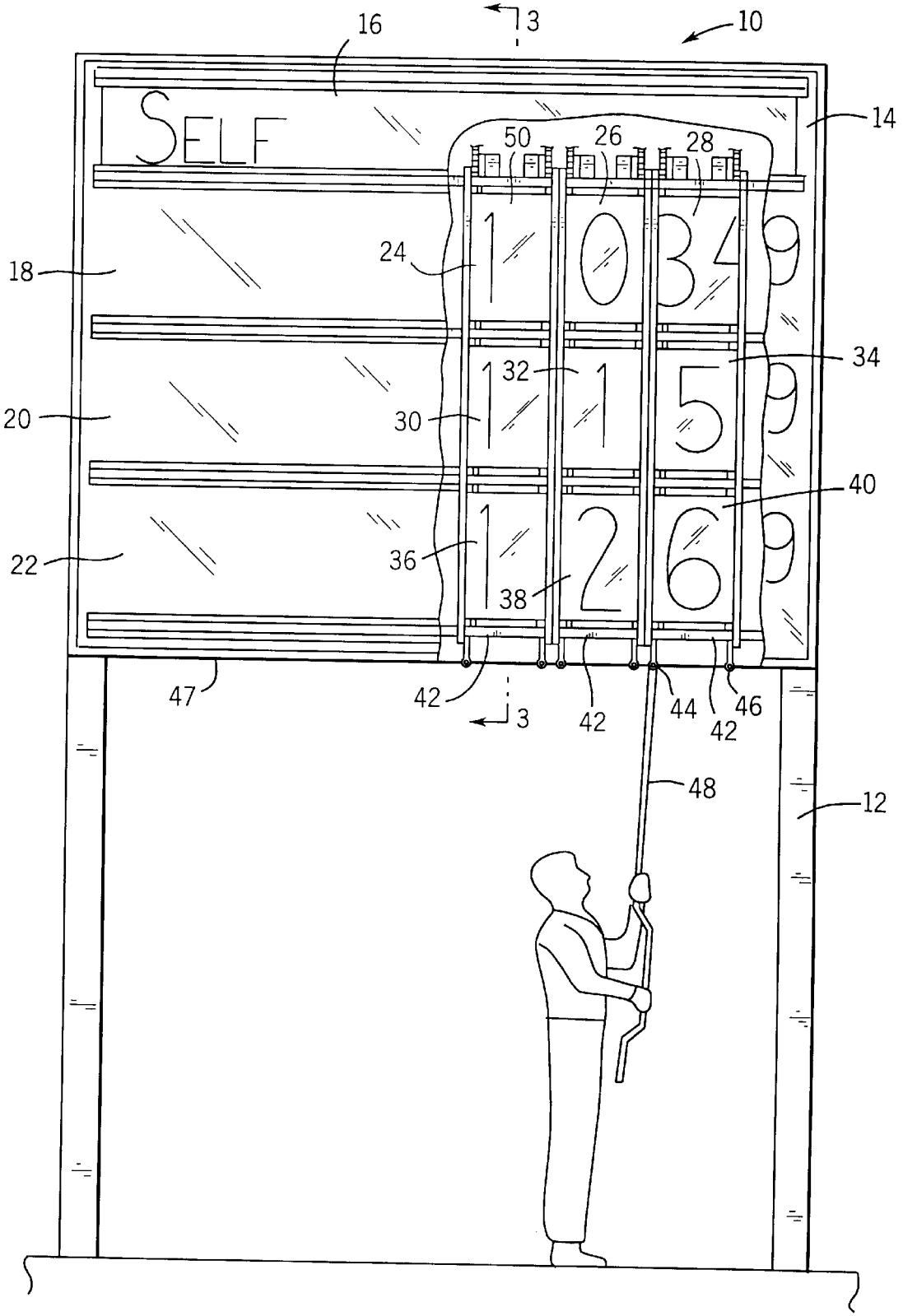
FIG. 1 is an illustration of a manually scrolling sign incorporating features of the subject invention.

The manual scrolling sign of the present invention is generally referred to by reference numeral 10 and is shown in FIG. 1. The scrolling sign 10 is particularly well suited for a gas station price sign and may be placed on stand alone, permanently installed sign posts 12, or may be used with a logo-type sign in combination with a price sign in the manner well known in the industry. The manual scrolling sign 10 includes a pair of opposed sign faces 14, one of which is shown in FIG. 1, which are designed to be fully or partially illuminated and provide a large, easy-to-read information panel 16 and a plurality of product panels 18, 20 and 22, where various products offered at the service center are identified. For example, the upper product panel 18 may identify regular unleaded gasoline, the middle product panel 20 unleaded mid-grade gasoline, and the lower product panel 22 premium unleaded gasoline. In the preferred embodiment of the invention, the sign face 14 is opaque and the indicia are backlighted by a series of fluorescent bulbs.

When the scrolling sign 10 is viewed as in FIG. 1, there are additional panels (not shown) immediately adjacent each of the product identification panels 18, 20 and 22. In the preferred embodiment of the invention, these panels are windows through which pricing indica are exposed. In the embodiment illustrated in FIG. 1, indicia 24, 26 and 28 are associated with the upper product panel 18. Price indicia 30, 32 and 34 are associated with the middle product panel 20. The price indicia 36, 38 and 40 are associated with the lower product panel 22.

In the preferred embodiment of the invention, the indicia 24, 30 and 36 are vertically aligned with one another and are each mounted to a modular digit mechanism 42. Likewise, indicia 26, 32 and 38 are mounted to an identical modular digit mechanism 42. Indicia 28, 34 and 40 are also mounted to an individual modular digit mechanism 42. Each of the modular digit mechanisms 42 securely mounts a plurality of indicia in vertical alignment with one another such that the indica are aligned with the viewing windows contained in the sign face 14. The modular digit mechanisms 42 can be removed from the sign as a single unit to permit ease of installation and allow retro-fitting of existing signage.

Although the modular digit mechanisms 42 are shown mounted vertically in the figures, it should be understood that the modular digit mechanisms can be mounted horizontally to display indicia through the sign face. If the modular digit mechanisms 42 are mounted horizontally, the orientation of the indicia would also be rotated 90°. A scrolling sign incorporating the modular digit mechanisms 42 mounted horizontally would be particularly useful in a sign that is ground mounted, such that the modular digit mechanisms 42 could be operated from the side of the sign rather than from below, as shown in FIG. 1. The detailed description of each modular digit mechanism 42 will be discussed in greater detail below.

In the illustrated embodiment in which price is expressed in decimal formal, the "tenths" indicia are permanently set as 9/10ths on the sign face 14 of the scrolling sign 10. The "penny" indicia 28, 34 and 40 are contained on a single modular digit mechanism 42. The penny indicia are adjustable to any digit between "0" and "9" and a blank space. Indicia 26, 32 and 38 display the "dime" column and are likewise adjustable to any digit between "0" and "9" and a blank space. The "dollar" indicia 24, 30 and 36 are used to display the dollar amount of the gasoline price. The dollar indicia 24, 30 and 36 can be selected to include a variety of numbers dependent upon current pricing of the product. In the preferred embodiment, the decimal point between the dime and dollar columns is printed directly on the sign face.

It will be appreciated that by appropriate modification, information can also be displayed in a non-decimal format. It may also be desirable to include other information indicia or a blank section on each web to indicate when an item is not for sale, or other messages.

Each of the modular digit mechanisms 42 includes a forward engagement ring 44 and a reverse engagement ring 46 which extend through the bottom edge 47 of the sign face 14. As shown in FIG. 1, the pricing indicia contained on an individual modular digit mechanism 42 may be selectively changed by inserting a hand crank 48 into either the forward engagement ring 44 or the reverse engagement ring 46 and manually turning the hand crank 48 until the desired price is depicted on the proper indicia. As will be discussed in greater detail below, the forward engagement ring 44 only allows the indicia to be advanced, while the reverse engagement ring 46 only allows the indicia to be decreased.

Figure 2:
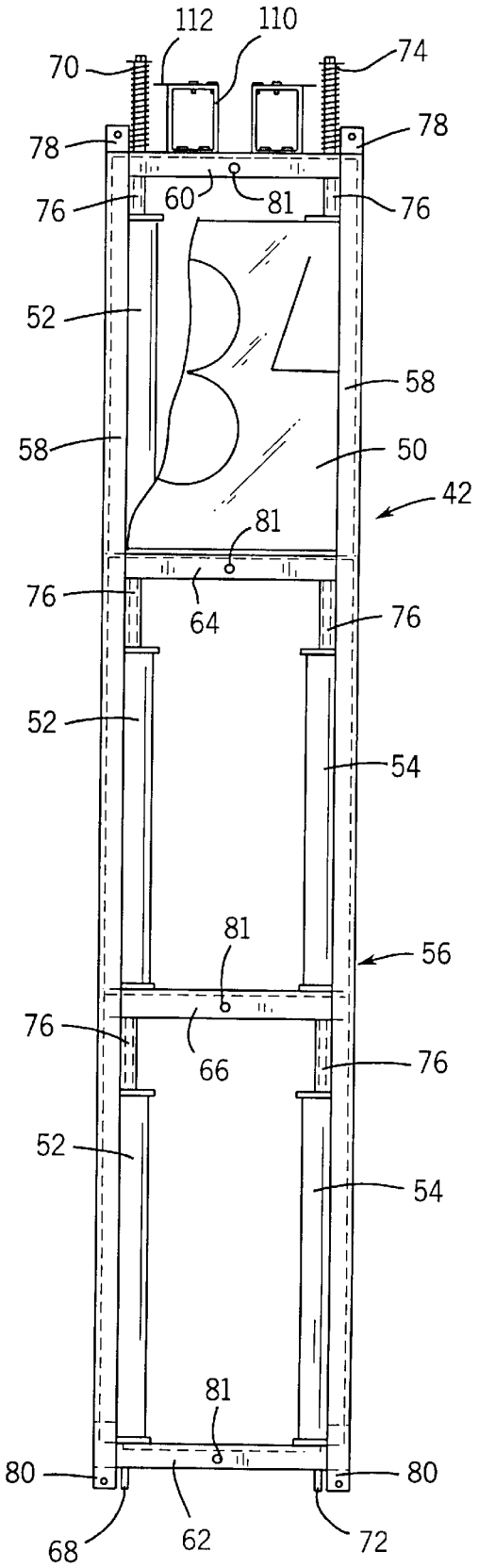
FIG. 2 is an elevation view of the modular digit mechanism including a plurality of indicia.

As can be seen and understood in FIGS. 1 and 2, each of the price indicia are contained on a plastic web 50 which extends between and is wound around a forward web roll 52 and a reverse web roll 54. In the illustrated embodiment, the indicia is printed on the web 50 such that rotation of the forward web roll 52 causes the web 50 to advance leftwardly in FIG. 2, thereby resulting in an increase of the numeral shown through the window of the sign face 14. As shown in FIG. 1, the indicia 28 is being advanced by rotating the forward web roll 52 such that the displayed numeral is changing from a "3" to a "4". Rotation of the reverse web roll 54 in a direction opposite to the rotation of the forward web roll 52 causes the web 50 to move rightwardly, thereby resulting in a decrease of the numeral shown through the window of the sign face 14, such that the price on the sign can be lowered.

In the alternate embodiment in which the modular digit mechanisms 42 are mounted horizontally, rotation of the forward web roll 52 causes the web to advance upwardly, while rotation of the reverse web roll 54 causes the web 50 to move downwardly. Additionally, when the modular digit mechanisms 42 are mounted horizontally, the forward engagement ring 44 and the reverse engagement ring 46 extend outwardly through one side of the sign 10.

The modular digit mechanisms 42 allow a series of forward web rolls 52 and reverse web rolls 54 to be mounted in vertical alignment with one another. As shown in FIG. 2, which is the rightmost modular digit mechanism 42 of the scrolling sign 10, the forward web rolls 52 for each of the indicia 28, 34 and 40 are vertically aligned with one another, as are the reverse web rolls 54 for the same indicia. By using a series of modular digit mechanisms 42, the individual indicia can be quickly and accurately mounted to the sign face 14 and the face frame 55 (FIG. 3) in the proper alignment. Although the modular digit mechanism 42 is shown in FIG. 1 as incorporating three separate indicia, it is understood that the modular digit mechanism 42 could be modified to include a different number of individual indicia. For example, modular digit mechanism 42 could be modified to include two or four indicia, depending upon the number of individual products available for sale at the gas station.

Referring now to FIGS. 2 and 3, the modular digit mechanism 42 includes a mounting frame 56 that is used to support the forward and reverse web rolls 52,54 in vertical alignment with one another. The mounting frame 56 has a plurality of vertical support members 58, a top cross member 60, a bottom cross member 62 and a series of intermediate cross members 64 and 66. The upper forward web roll 52 and reverse web roll 54 are supported at their lower end by the first intermediate cross member 64. The middle forward web roll 52 and reverse web roll 54 are supported at their lower end by the second intermediate cross member 66, while the lower forward web roll 52 and reverse web roll 54 are supported by the bottom cross member 62. Each of the forward web rolls 52 and reverse web rolls 54 are freely rotatable with respect to the mounting frame 56.

A forward drive shaft 68 extends upward through each of the forward web rolls 52 and each of the cross members 60–66. The forward drive shaft 68 extends upward past the top cross member 60 until it terminates at a top end 70. Likewise, a reverse drive shaft 72 extends upward through each of the aligned, reverse web rolls 54 and the cross members 60–66. The reverse drive shaft 72 also extends through the top cross member 60 and terminates at a top end 74. A hollow, cylindrical roll spacer 76 is positioned between each of the forward and reverse web rolls 52, 54 and one of the cross members 60, 64, 66. The roll spacers 76 surround the forward and reverse drive shafts 68,72 to provide the desired spacing between the vertically aligned forward and reverse web rolls 52,54 and prevent vertical movement of the web rolls, such that the indicia supported by modular digit mechanism 42 will be positioned in front of the windows on the sign face 14 of the scrolling sign 10.

The mounting frame 56 includes a pair of upper attachment brackets 78 and a pair of lower attachment brackets 80 which are used to attach the mounting frame 56 to the face frame 55 of the scrolling sign 10. Each of the cross members 60–66 includes an attachment hole 81 that is used to attach each of the modular digit mechanisms 42 directly to the sign face 14. In this manner, the modular digit mechanisms 42, the face frame 55 and the sign face 14 form a single unit.

Referring now to FIG. 3, it can be seen that a driving mechanism 82 is attached to the bottom end of the forward drive shaft 68. The driving mechanism 82 includes a ratchet driver 84 and an engagement portion 86. The engagement portion 86 of the driving mechanism 82 extends through an opening 88 in the bottom of the sign face 14. In a fully illuminated sign, the engagement portion 86 extends through openings in the sign cabinet rather than the sign face 14, since in a fully illuminated sign, the modular digit mechanisms 42 are not mounted to the sign face 14, but are spaced therefrom to prevent shadows. As previously discussed, the forward engagement ring 44 contained on the engagement portion 86 is thus accessible from the bottom of the sign, as shown in FIG. 1. Although the driving mechanism 82 is shown as applied to the forward drive shaft 68, a similar driving mechanism 82 is also present on the reverse drive shaft 72.

When the three modular digit mechanisms 42 are mounted to the sign frame 12, as shown in FIG. 1, the user is able to change any of the individual indicia by engaging the drive mechanism 82 of the modular digit mechanism 42 having the indicia which is desired to be changed. In FIG. 1, the user is changing indicia 28 of the right-most modular digit mechanism 42. The operation of the drive mechanism 82 and the forward drive shaft 68 in effecting movement of the indicia 28 will be discussed below.

Figure 4:
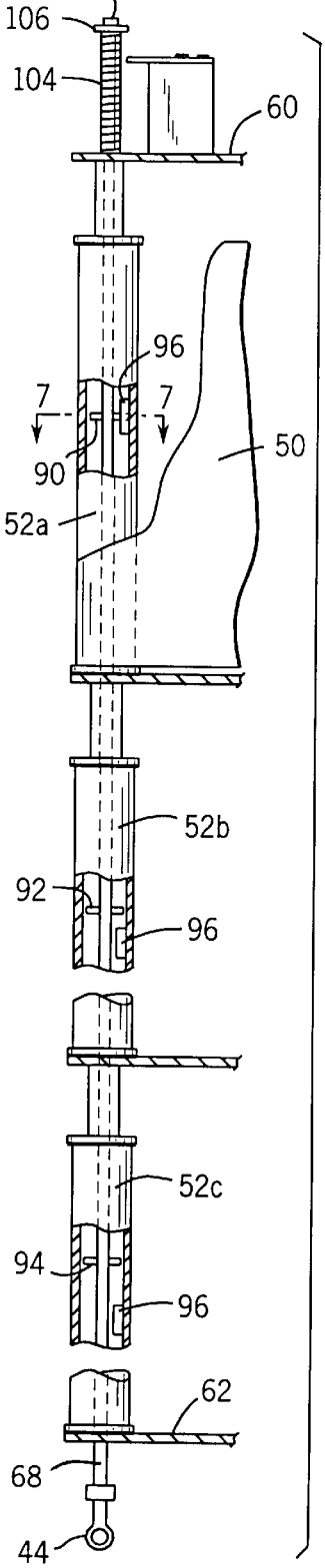
FIG. 4 is a front enlarged fragmentary view showing the position of the drive shaft when engaging the uppermost web roll.
Figure 5:
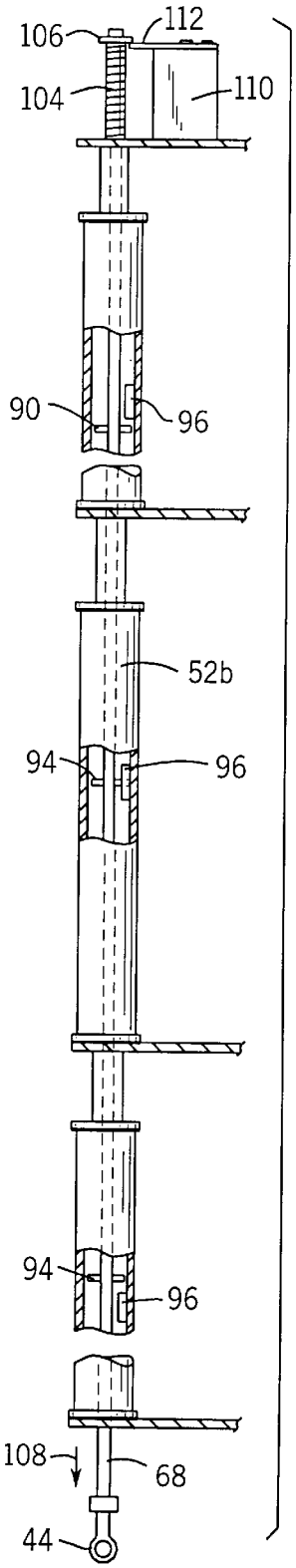
FIG. 5 is a front enlarged fragmentary view showing the position of the drive shaft when engaging the middle web roll.
Figure 6:
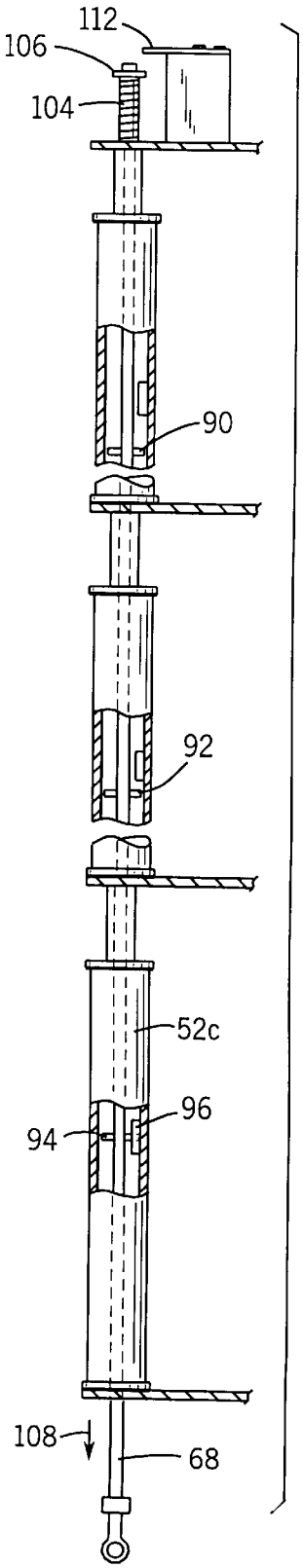
FIG. 6 is a front enlarged fragmentary view showing the position of the drive shaft when engaging the lowermost web roll.

Referring now to FIGS. 4–6, the method of selecting the indicia to be changed will be discussed in detail. FIGS. 4–6 illustrate the forward drive shaft 68 and a series of forward web rolls 52*a–c*. The reverse drive shaft 72 and reverse web rolls 54 are identical to those shown in FIGS. 4–6 and the discussion of which has been omitted for space saving reasons only.

As can be seen in FIGS. 4–6, the forward drive shaft 68 extends through both the upper cross member 60 and the bottom cross member 62. The forward drive shaft 68 includes an upper pin 90, a middle pin 92 and a lower pin 94. Each of the pins 90, 92 and 94 pass through the center of the forward drive shaft 68 and extend outwardly from the forward drive shaft 68, as shown for example by the upper pin 90 in FIG. 7. Each of the forward web rolls 52*a–c* is a hollow cylindrical member having an internal diameter. As can be understood in FIG. 7, the length of the upper pin 90 is less than the internal diameter of the forward web roll 52*a*, such that the forward drive shaft 68 can rotate within the forward web roll 52*a* when the upper pin 90 is mounted therethrough. The middle pin 92 and the lower pin 94 are similarly mounted through the forward drive shaft 68 and have the same length as the upper pin 90, shown in FIG. 7. Although not shown, the reverse drive shaft 72 is constructed identical to the forward drive shaft 68 and includes the upper, middle and lower pins 90–94.

The forward web rolls 52 and reverse web rolls 54 are identical and each include a drive lug 96 securely mounted to inside wall 98. The drive lug 96 includes an extending portion 100 that extends radially inward from the inside wall 98. The extending portion 100 of the drive lug 96 extends inwardly a distance sufficient to engage the upper pin 90 when the forward drive shaft 68 is rotated as shown by arrow 102 in FIG. 7. Thus, as the forward drive shaft 68 is rotated, the upper pin 90 engages the extending portion 100 of drive lug 96. Further rotation of the forward drive shaft 68 will cause the entire forward web roll 52*a* to rotate, thereby causing more of the web 50 to be wound around the forward web roll 52*a*. In this manner, the indicia printed on the web 50 can be advanced such that the price displayed by the scrolling sign 10 is changed.

Each of the forward web rolls 52, shown in FIGS. 4–6, and the reverse web rolls 54 are identical such that the drive lug 96 is located the same distance from the top and bottom of the web roll. Referring to FIG. 4, a biasing element 104 is positioned around the portion of the forward drive shaft 68 extending upward past the top cross member 60. In the preferred embodiment of the invention, the biasing element 104 is a metal spring. The biasing element 104 is positioned between the top cross member 60 and a washer 106 affixed to the top end 70 of the forward drive shaft 68. FIG. 4 shows the position of the bias member 104 in its extended-most position. When the bias member 104 is in its extended-most position, and no downward force is being applied to the forward engagement ring 44, the forward drive shaft 68 assumes the resting or biased position shown in FIG. 4.

When the forward drive shaft 68 is in the biased position of FIG. 4, the upper pin 90 is in a vertical position such that it is able to engage the drive lug 96 contained on the uppermost forward web roll 52*a*. When the upper pin 90 is engaging the drive lug 96 of the uppermost forward web roll 52*a*, the middle pin 92 is positioned slightly above the drive lug 96 of the middle forward web roll 52*b*. Likewise, the lower pin 94 is positioned well above the drive lug 96 of the lowermost forward web roll 52*c*. In the resting, biased position, only the uppermost forward web roll 52*a* is engaged by the forward drive shaft 68. Therefore, upon rotation of the forward drive shaft 68, only the uppermost forward web roll 52*a* will rotate. When the forward drive shaft 68 is rotated, the middle pin 92 and the lower pin 94 will freely rotate within the hollow interior of the middle and lowermost forward web rolls 52*b* and 52*c*. Thus, by selecting the position of the upper pin 90, the middle pin 92, and the lower pin 94 on the forward drive shaft 68 relative to the drive lugs 96, only one of the forward web rolls 52*a–c* will rotate at a time.

If the user wishes to change the indicia on the web 50 wound around the middle forward web roll 52*b*, the user applies a downward force to the forward engagement ring 44 as indicated by arrow 108. As the user applies the downward force on the forward engagement ring 44, the bias element 104 is compressed until the middle pin 92 is aligned with the drive lug 96 mounted on the interior of the middle forward web roll 52*b*, as shown in FIG. 5. When the middle pin 92 is vertically aligned with the drive lug 96 on the middle forward web roll 52*b*, the upper pin 90 is located below the drive lug 96 contained on the uppermost forward web roll 52*a*. At the same time, the lower pin 94 is located slightly above the drive lug 96 mounted to the lowermost forward web roll 52*c*. In this position of forward drive shaft 68, rotation of the forward drive shaft 68 will result in rotation of only the middle forward web roll 52*b*. Thus, only the middle indicia 34, FIG. 1, contained on the modular digit mechanism 42 will be changed.

In the preferred embodiment of the invention, an indicator bracket 110 is securely mounted to the top cross member 60 of the mounting frame 56. The indicator bracket 110 includes a flexible tab 112 which extends horizontally outward from the main body of the bracket 110. In the preferred embodiment of the invention, the flexible tab 112 is a thin piece of metal that is sufficiently resilient to flex downward in a manner to be discussed. As shown in FIG. 5, the height of the indicator bracket 110 is selected such that the washer 106 affixed to top end 70 of the forward drive shaft 68 contacts the flexible tab 112 when the middle pin 92 is vertically aligned with the drive lug 96 contained on the middle forward web roll 52*b*. Thus, as the user applies a downward force to the forward engagement ring 44, the user can feel the washer 106 contact the flexible tab 112. The physical contact between the washer 106 and the flexible tab 112 indicates to the operator that the middle pin 92 is aligned with the drive lug 96 of middle forward web roll 52*b*. While maintaining the downward force 108 applied to the forward engagement ring 44 to hold the washer 106 in contact with the flexible tab 112, the user can then rotates the forward drive shaft 68 to change the indicia 34 on the web 50 wound around the middle forward web roll 52*b*.

Referring now to FIG. 6, thereshown is the position of the forward drive shaft 68 in which the lower pin 94 is engaging the drive lug 96 of the lowermost forward web roll 52*c*. In this position, the upper pin 90 is well below the drive lug 96 of the uppermost forward web roll 52*a*, while the middle pin 92 is slightly below the drive lug 96 of the middle forward web roll 52*b*. With the forward drive shaft 68 in the position shown in FIG. 6, rotation of the forward drive shaft 68 will only rotate the lowermost forward web roll 52*c*. As the forward drive shaft 68 is moved to the position shown in FIG. 6, the bias element 104 becomes completely compressed and the washer 106 causes the flexible tab 112 to flex downward and thereby allowing the washer 106 to pass below the flexible tab 112. The sign operator is able to determine that the lower pin 94 is aligned with the drive lug 96 of the lowermost forward web roll 52*c* when the forward drive shaft 68 will no longer move any further downward due to the complete compression of bias element 104.

Although FIGS. 4–6 only depict the forward drive shaft 68 and the forward web rolls 52*a–c*, it is understood that the reverse web rolls 54 and the reverse drive shaft 72 are identical to those shown in FIGS. 4–6. As can be understood in FIGS. 4–6, the position of the upper pin 90, middle pin 92, and lower pin 94 along forward drive shaft 68 with respect to the drive lug 96 contained on each of the forward web rolls 52*a–c* determines the selection of the indicia to be changed. It is important that the pins 90–94 engage only one of the drive lugs 96 at a time.

Additionally, although FIGS. 4–6 depict the modular digit mechanism 42 having three sets of forward and reverse web rolls, it is understood that the modular digit mechanism 42 could be modified to display a different number of indicia. For example, modular digit mechanism 42 could be modified to display four indicia such that the modular sign 10 would show four prices at a time. If the modular digit mechanism 42 displays four indicia, a second flexible tab 112 could be added to the indicator bracket 110 to indicate the additional position of forward and reverse drive shafts. Likewise, if the modular digit mechanism 42 were modified to display only two indicia, the indicator bracket 110 could be removed since the forward and reverse drive shafts would only be movable between two positions.

In the preferred embodiment of the invention, the hand crank actuator 48 includes a loop which engages the forward engagement ring 44. It is important that the loop contained on the hand crank actuator 48 allows the operator to apply downward force in the direction of arrow 108 as well as the rotational force required to rotate the selected forward web roll 52.

In the preferred embodiment of the invention, it is particularly desirable that the forward web rolls 52 be rotatable only in the clockwise direction when viewed from above, while the reverse web rolls 54 be rotatable in only the counter-clockwise direction when viewed from above. The restricted one-way rotation of the forward web rolls 52 and reverse web rolls 54 prevents slack from being introduced into the plastic web 50 containing the price indicia. In the preferred embodiment of the invention, each of the forward web rolls 52 and reverse web rolls 54 include differential braking means, as shown and described in U.S. Pat. No. 4,741,118, entitled: "Sign With Improved Scrolling Mechanism," issued to R. B. Aitken et al on May 3, 1988. U.S. Pat. No. 4,741,118 is incorporated by reference herein. The differential braking mechanism described in the above-identified patent provides the required tension in web 50, such that the web 50 and indicia printed thereon remain taut between the forward web roll 52 and reverse web roll 54. If the forward web roll 52 and reverse web roll 54 were allowed to rotate in both directions, slack could be introduced into the web.

Referring now to FIGS. 8–10, the driving mechanism 82 for preventing rotation of the forward and reverse drive shafts 68,72 in the improper direction is there-shown. Referring first to FIG. 8, the driving mechanism 82 is shown as attached to the reverse drive shaft 72. The driving mechanism 82 generally includes a ratchet driver 84 and an engagement portion 86. The ratchet driver includes a body 114 that can be securely fixed to the bottom end of the reverse drive shaft 72. In the preferred embodiment of the invention, body 114 of the ratchet driver 84 is generally box-shaped having an open back wall. The body 114 is securely attached to the reverse drive shaft 72 by a removable attachment means 116 that passes through an opening 118 in the body 114 and a bore 120 through the reverse drive shaft 72 as shown in FIG. 10. In the preferred embodiment of the invention, attachment means 116 is a conventional cotter pin. It is particularly desirable that the driving mechanism 82 be removable from the forward and reverse drive shafts 68, 72 such that the modular digit mechanism 42 can be easily removed from the sign support frame 12. When the modular digit mechanism 42 is to be removed, the driving mechanism 82 is detached from both the forward and reverse drive shafts 68, 72. When removed, the driving mechanism 82 will rest against the bottom edge surface of the sign face 14, as can be understood in FIG. 3. Thus, the opening 88 in the bottom edge 47 of the sign can be made smaller than the forward engagement ring 44 to prevent moisture from entering the sign.

Referring again to FIG. 8, the body 114 of the ratchet driver 84 includes an open slot 122 in the front wall 123 and a leaf spring 124. The leaf spring 124 is connected at one end to the front wall 123 by a screw 126. In the preferred embodiment of the invention, the leaf spring 124 is a portion of flexible metal which can flex outward while having the required stiffness to effect rotation of the reverse drive shaft 72.

The engagement portion 86 of the driving mechanism 82 consists of an elongated shaft 128 securely connected to the reverse engagement ring 46. The shaft 128 includes a driving pin 130 which passes through the center of the shaft 128. As can be seen in FIG. 10, the drive pin 130 has a length greater than the width of the body 114 of the ratchet driver 84, such that a portion of the driving pin 130 extends through the slot 122 contained in the front wall 123 of body 114. The upper end of the shaft 128 is contained within the body 114 and is in close physical proximity to the bottom end of the reverse drive shaft 72, as can be seen in FIG. 9. However, the shaft 128, and thus the entire engagement portion 86, is freely rotatable with respect to the reverse drive shaft 72. A washer 131 surrounds the shaft 128 to help prevent the engagement portion 86 from escaping the body 114 and to allow free rotation of the engagement portion 86.

When the engagement portion 128 is rotated in the direction shown by arrow 132, the portion of drive pin 130 extending through the slot 122 contacts the edge surface 134 of the leaf spring 124. Since the leaf spring 124 is stiff in the longitudinal direction, further rotation of the engagement portion 86 in the direction shown by arrow 132 will cause the ratchet driver 84 to rotate in the same direction. Since the ratchet driver body 114 is securely fixed to the bottom end of the reverse drive shaft 72, this rotation will cause the drive shaft 72 to rotate in the same direction. Thus, when rotating the engagement portion 86 in the direction shown by arrow 132, the user can move the indicia coupled to the reverse drive shaft 72, as previously discussed.

If the engagement portion 86, shown in FIG. 8, is rotated in the direction opposite arrow 132, the drive pin 130 contacts the underside of leaf spring 124, as can be understood in FIG. 10. When rotating in the direction opposite arrow 132, the drive pin 130 will cause the leaf spring to deflect outward, as shown in phantom in FIG. 10. Thus, the drive pin 130 will not engage the ratchet driver 84 and the engagement portion 128 will freely spin within the body 114. By using the ratchet driver shown in FIG. 8–10, the reverse drive shaft 72 is allowed only to rotate in the direction shown by arrow 132. This prevents slack from being introduced into the web 50, as previously discussed. Although the driving mechanism 82 has only been discussed as connected to the reverse drive shaft 72, it is understood that a nearly identical structure is connected to the forward drive shaft 68. However, on the driving mechanism 82 attached to the forward drive shaft 68, the leaf spring 124 is connected on the left side of the front wall 123 of body 114, such that the forward drive shaft 68 can rotate only in the direction opposite arrow 132. Thus, the driving mechanism 82 attached to the forward drive shaft 68 prevents rotation of the forward drive shaft 68 in the direction shown by arrow 132.

Although the driving mechanism 82 including the ratchet driver 84 has been discussed in detail, it is understood that other various equivalents and alternatives could be substituted for the embodiment shown in FIGS. 8–10 while operating under the scope of the invention. The important aspect of the driving mechanism 82 and ratchet driver 84 is that the forward drive shaft 68 and reverse drive shaft 72 are each rotatable only in one direction to prevent slack in the web 50.

Referring now to FIGS. 11–13, the method of mounting the modular digit mechanism 42 onto the face frame 55 is thereshown. The face frame 55 includes a top support wall mount 138 which has a generally box-shaped cross section and extends the entire length of the scrolling sign 10. A top mounting angle bracket 140 is securely connected to the top support wall mount 138 by a series of screw connectors 142. As can be seen in FIG. 13, the top mounting angle bracket 140 includes a series of extended mounting sections 144 which include a series of keyhole openings 146. Each of the keyhole openings include a hole 148 and a slot 150.

Referring again to FIG. 11, a peg assembly 152 is connected to a hole passing through each of the upper attachment brackets 78 on the mounting frame 56. The peg assembly 152 includes a spacer 154, a washer 156 and a screw 158. The threaded shaft of screw 158 is received by the opening in the upper attachment bracket 78.

To attach the modular digit mechanism 42 to the face frame 55, the peg assembly 154 is inserted into the hole portion 148 of the keyhole 146. Once the washer 156 of the peg assembly 152 has passed through the hole portion 148, the modular digit mechanism 42 is lowered until the spacer 154 contacts the bottom of the slot portion 150 of keyhole 146, as shown in FIG. 11. As can be understood in FIG. 13, the diameter of washer 156 is larger than the diameter of the slot 150 such that the peg assembly 152 securely holds the modular digit mechanism 42 within the keyhole 146. When removing the modular digit mechanism 42 from the face frame 55, the modular digit mechanism 42 is raised until the washer 156 is aligned with the hole portion 148. Once the washer 156 is properly aligned, the entire modular digit mechanism 42 can be moved outward away from the top mount angle bracket 140. In this manner, the modular digit mechanism 42 can be quickly and easily mounted to the top support wall mount 138 of the scrolling sign 10.

Once the top end of the modular digit mechanism 42 is mounted to the top mounting angle bracket 140, the lower attachment brackets 80 can be securely attached by the use of a screw or bolt to the bottom support wall mount 160, as shown in FIG. 3.

Referring now to FIG. 3, it can be seen that the sign face 14, the face frame 55 including the top support wall mount 138 and the bottom support wall mount 160, and the modular digit mechanisms 42 create a single structure. The single structure includes a pair of brackets 162 which are used to attach the combined unit to the sign cabinet (not shown). In a preferred embodiment of the invention, the upper bracket 162 could be mounted to the sign cabinet by a hinge, such that the entire unit could be pivoted upward about the hinged connection between the upper bracket 162 and the sign cabinet. In this manner, the entire unit, including the modular digit mechanisms 42, could be pivoted away from the sign cabinet to provide access to the lights contained within the cabinet.

Additionally, the single structure consisting of the sign face 14, the face frame 55, and the modular digit mechanisms 42 could simply be attached to an existing sign cabinet such that the existing sign can be retrofit with the improved digit changing mechanism of the invention. Thus, the existing sign posts 12 and sign cabinet could be left in place and retrofit with the combination of the sign face 14, face frame 55 and modular digit mechanisms 42 as discussed in the invention. By retrofitting the existing sign, many of the costs associated with removing the existing sign are eliminated.

Although the modular digit mechanism 42 and price indicia have been discussed for only one side of the scrolling sign 10, it should be understood that the structure for securing the webs and permitting movement of the indicia is duplicated on both sides of the sign, with identical window indicia panels visible from both sides of the sign. Thus, the scrolling sign 10 shown in the Figures includes six modular digit mechanisms 42, three of which are visible from each side of the sign.

We claim:

1. A scrolling sign comprising:

a support frame;

a sign face through which a plurality of indicia may appear, the sign face being supported by the support frame;

a plurality of rotatable forward web rolls and a plurality of rotatable reverse web rolls, each of the forward and reverse web rolls having an axis of rotation, indicia being contained on each web extending between the forward and reverse web rolls;

a mounting frame connected to the support frame positioning the plurality of forward web rolls in alignment with each other and the plurality of reverse web rolls in alignment with each other; and a rotatable forward drive shaft extending through and movable along the axis of rotation of each of the forward web rolls and a rotatable reverse drive shaft extending through and movable alone the axis of rotation of each of the reverse web rolls, each of the drive shafts having a plurality of pins extending therefrom, the pins on the drive shaft being spaced such that only one of the plurality of pins selectively engages only one of the forward and reverse web rolls at a time to permit rotation of the web rolls in accordance with rotation of the drive shaft.

2. The scrolling sign of claim 1 further comprising a biasing means coupled to each of the forward and reverse drive shafts, the biasing means biasing the forward and reverse drive shafts into a first position in which only one of the plurality of pins on the drive shaft engages only a first forward web roll and a first reverse web roll.

3. The scrolling sign of claim 2 wherein the biasing element is a spring positioned between the mounting frame and each of the forward and reverse drive shafts.

4. The scrolling sign of claim 2, wherein the forward and reverse drive shafts are movable against the biasing means to a second position in which only one of the plurality of pins on the drive shafts engages only a second forward web roll and a second reverse web roll.

5. The scrolling sign of claim 1 wherein the forward and reverse drive shafts are movable to select which of the forward and reverse web rolls are engaged by the pins on the drive shafts.

6. The scrolling sign of claim 1 further comprising a driving mechanism in a rotational force transmitting relation to each of the forward and reverse drive shafts.

7. The scrolling sign of claim 6 wherein the driving mechanism includes an engagement portion, the engagement portion selectively receiving a hand crank for manually rotating the drive shafts to move the web between the forward and reverse web rolls.

8. A scrolling sign comprising:

a support frame;

a sign face through which a plurality of indicia may appear, the sign face being supported by the support frame;

a plurality of rotatable forward web rolls and a plurality of rotatable reverse web rolls, indicia being contained on each web extending between the forward and reverse web rolls;

a mounting frame connected to the support frame positioning the plurality of forward web rolls in alignment with each other and the plurality of reverse web rolls in alignment with each other;

a rotatable forward drive shaft extending through each of the forward web rolls and a rotatable reverse drive shaft extending through each of the reverse web rolls, each of the drive shafts having a plurality of pins extending therefrom such that only one of the plurality of pins on the drive shaft selectively engages the forward and reverse web rolls to permit rotation of the web rolls in accordance with rotation of the drive shaft; and a driving mechanism in a rotational force transmitting relation to each of the forward and reverse drive shafts, wherein the driving mechanism includes a ratchet driver for providing a force transmitting connection between the engagement portion and each of the forward and reverse drive shafts, the ratchet driver allowing rotation of the forward drive shaft only in a first direction and allowing rotation of the reverse drive shaft only a second, opposite direction.

9. A scrolling sign comprising:

a support frame;

a sign face through which a plurality of indicia may appear, the sign face being supported by the support frame;

a plurality of rotatable forward web rolls and a plurality of rotatable reverse web rolls, indicia being contained on each web extending between the forward and reverse web rolls;

a mounting frame connected to the support frame positioning the plurality of forward web rolls in alignment with each other and the plurality of reverse web rolls in alignment with each other; and a rotatable forward drive shaft extending through each of the forward web rolls and a rotatable reverse drive shaft extending through each of the reverse web rolls, each of the drive shafts having a plurality of pins extending therefrom such that only one of the plurality of pins on the drive shaft selectively engages the forward and reverse web rolls to permit rotation of the web rolls in accordance with rotation of the drive shaft; and attachment pegs securely connected to the mounting frame, the mounting pegs being received in a pair of key holes in the support frame such that the mounting frame is removable from the support frame.

10. The scrolling sign of claim 1 wherein the sign includes two or more mounting frames.

11. The scrolling sign of claim 1 further comprising an indicator bracket connected to the mounting frame, the indicator bracket being positioned to indicate the position of the drive shaft as the drive shaft is moved along the axis of rotation of the web rolls, such that the user can determine which of the forward and reverse web rolls are engaged by the pins on the drive shaft.

12. The scrolling sign of claim 1 wherein the mounting frame is connected to the sign face such that the mounting frame, the sign face and the support frame form a single unit.

13. A scrolling sign comprising:

a support frame;

a sign face through which a plurality of indicia may appear, the sign face being supported by the support frame;

a plurality of forward web rolls and a plurality of reverse web rolls, each of the forward and reverse web rolls having an axis of rotation, indicia being contained on each web wound between the forward and the reverse web rolls, wherein rotation of the web rolls causes the indicia to change;

a mounting frame positioning the plurality of forward web rolls in alignment with each other and the plurality of reverse web rolls in alignment with each other;

a forward drive shaft extending through each of the aligned forward web rolls, the forward drive shaft being movable along the axes of rotation of the aligned forward web rolls, the forward drive shaft including a plurality of spaced pins extending outward therefrom, such that rotation of the forward drive shaft causes only one of the plurality of pins to engage one of the forward web rolls at a time;

a reverse drive shaft extending through each of the aligned reverse web rolls, the reverse drive shaft being movable, along the axes of rotation of the aligned reverse web rolls, the reverse drive shaft including a plurality of spaced pins extending outwardly therefrom, such that rotation of the reverse drive shaft causes only one of the plurality of pins to engage one of the reverse web rolls at a time; and a driving mechanism coupled to each of the forward and reverse drive shafts, the driving mechanism permitting rotation of the forward drive shaft only in a first direction and permitting rotation of the reverse drive shaft only in a second, opposite direction.

14. The scrolling sign of claim 13 further comprising a biasing means positioned between the mounting frame and each of the forward and reverse drive shafts, the biasing means forcing the forward and reverse drive shafts into a biased position in which only one of the plurality of pins on the drive shafts engages a first of the plurality of forward web rolls and a first of the plurality of reverse web rolls.

15. The scrolling sign of claim 14 wherein the forward and reverse drive shafts are each movable to a second position in which only one of the plurality of pins on the drive shafts engages a second of the plurality of forward and reverse web rolls.

16. The scrolling sign of claim 15 further comprising an indicator bracket connected to the mounting frame, the indicator bracket indicating the vertical position of the drive shafts to differentiate between the first and second position of each drive shaft.

17. The scrolling sign of claim 13 wherein the driving mechanism includes a ratchet driver and an engagement portion, the ratchet driver being in rotational force transmitting relation between the drive shaft and the engagement portion.

18. The scrolling sign of claim 17 wherein the engagement portion is freely rotatable within the ratchet driver, the engagement portion including an engagement pin which engages the ratchet driver when the engagement portion is rotated in one direction.

19. The scrolling sign of claim 13 further comprising a plurality of drive lugs mounted to each of the forward and reverse web rolls, the drive lugs being engageable by the pins on the forward and reverse drive shafts.

20. The scrolling sign of claim 13 wherein the mounting frame is connected to the sign face.

21. The scrolling sign of claim 20 wherein the support frame, the sign face, and the mounting frame are connected to form a single unit.

22. A modular digit display mechanism connectable to the support frame of a scrolling sign for displaying a plurality of indicia, the display mechanism comprising:

a plurality of rotatable forward web rolls and a plurality of rotatable reverse web rolls, each of the forward and reverse web rolls having an axis of rotation, indicia being contained on each web extending between the forward and reverse web rolls;

a mounting frame positioning the plurality of forward web rolls in axial alignment with each other and the plurality of reverse web rolls in axial alignment with each other;

a forward drive shaft extending through and movable along the axis of rotation of each of the aligned forward web rolls, the forward drive shaft having a plurality of pins spaced to engage only one of the forward web rolls at a time, such that rotation of the forward drive shaft rotates only one of the forward web rolls at a time;

a reverse drive shaft extending through and movable along the axis of rotation of each of the aligned reverse web rolls, the reverse drive shaft having a plurality of pins spaced to engage only one of the reverse web rolls at a time, such that rotation of the reverse drive shaft causes only one of the reverse web rolls to rotate at a time; and a driving mechanism coupled to each of the forward and reverse drive shafts, the driving mechanism permitting rotation of a drive shaft only in a first direction and permitting rotation of the reverse drive shaft only in a second, opposite direction.

23. The display mechanism of claim 22 further comprising a biasing means positioned between the mounting frame and each of the forward and reverse drive shafts, the biasing means forcing the forward and reverse drive shafts into a biased position in which the drive shafts engage a first of the plurality of forward web rolls and a first of the plurality of reverse web rolls.

24. The display mechanism of claim 23 wherein the forward and reverse drive shafts are each movable to a second position in which only one of the plurality pins on the drive shafts engages a second of the plurality of forward and reverse web rolls.

25. The display mechanism of claim 23 wherein the biasing means is a spring positioned between the mounting frame and each of the forward and reverse drive shafts.

26. The display mechanism of claim 22 further comprising attachment pegs securely connected to the mounting frame, the mounting pegs being received in a pair of keyholes in the support frame such that the mounting frame can be removably attached to the support frame of the sign.

27. The scrolling sign of claim 22 wherein the driving mechanism includes a ratchet driver and an engagement portion, the ratchet driver being in a rotational force transmitting relation between the drive shaft and the engagement portion.

28. The display mechanism of claim 27 where the engagement portion is freely rotatable in the ratchet driver, the engagement portion including an engagement pin which engages the ratchet driver when the engagement portion is rotated in only one direction within the ratchet driver.

29. The display mechanism of claim 22 further comprising plurality of drive lugs mounted to each of the forward and reverse web rolls, the drive lugs being engageable by the pins on the forward and reverse drive shafts.

* * * * *